US006393845B1

(12) United States Patent
Nogawa et al.

(10) Patent No.: US 6,393,845 B1
(45) Date of Patent: May 28, 2002

(54) PULSE TUBE REFRIGERATOR

(75) Inventors: Masafumi Nogawa, Toyota; Shin Kawano; Shaowei Zhu, both of Kariya; Tatsuo Inoue, Anjo, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/698,051

(22) Filed: Oct. 30, 2000

(30) Foreign Application Priority Data

Oct. 28, 1999 (JP) ..... 11-306895

(51) Int. Cl.[7] ..... F25B 9/00
(52) U.S. Cl. ..... 62/6
(58) Field of Search ..... 62/6

(56) References Cited

U.S. PATENT DOCUMENTS 3,690,113 A * 9/1972 Mokadam ..... 62/6
5,481,878 A * 1/1996 Shaowei ..... 62/6
6,094,921 A 8/2000 Zhu et al. ..... 62/6

* cited by examiner

*Primary Examiner*—William C. Doerrler
(74) *Attorney, Agent, or Firm*—Oblon, Spivak, McClelland, Maier & Neustadt, P.C.

(57) ABSTRACT

A pulse tube refrigerator which reduces valve losses in a cycle and improves refrigeration efficiency includes a pressure oscillator, a refrigerating portion, a first middle pressure buffer tank, a first middle pressure buffer side valve, a second middle pressure buffer tank and a second middle pressure buffer side valve. A regenerator in the refrigerating portion and an outlet port and an inlet port of a compressor in the pressure oscillator are connected via a high pressure valve and a low pressure valve respectively. A high temperature heat exchanger of the refrigerating portion and the first middle pressure buffer tank and the second middle pressure buffer tank are connected via the first middle pressure buffer side valve and the second middle pressure buffer side valve. The first middle pressure buffer tank and the second middle pressure buffer tank include different middle pressures which are predetermined between an output pressure and an input pressure of the compressor.

12 Claims, 8 Drawing Sheets

PULSE TUBE REFRIGERATOR

The entire disclosure of Japanese Patent Applications No. Hei 11-306895 filed on Oct. 28, 1999 including the specification, drawings and abstract, is incorporated herein by reference in its entirety.

BACKGROUND OF THE INVENTION

1. Field of the Invention

This invention relates to a pulse tube refrigerator and, more particularly, to a pulse tube refrigerator for cryogenic refrigeration.

2. Description of the Related Art

A pulse tube refrigerator is attractive as a cryogenic refrigerator. The pulse tube refrigerator refrigerates a working fluid by oscillating the working fluid therein, by shifting the phase of the pressure change and the position change.

Various structures for a pulse tube refrigerator of this kind have been proposed. For instance, the one introduced by M. David et al, in Cryogenics, Vol. 30, (1990), P. 262–266, and illustrated in the block diagram of FIG. 4. A pulse tube refrigerator 60 of this structure comprises a pressure oscillator 61, a refrigerating portion 62, a middle pressure buffer tank 63 and a middle pressure buffer side valve 64.

The pressure oscillator 61 generating pressure oscillation to the working fluid filled in the pulse tube refrigerator 60 comprises a compressor 71, a high pressure valve 72 and a low pressure valve 73. An outlet port 71*a* of the compressor 71 is connected to the refrigerating portion 62 via the high pressure valve 72. An inlet port 71*b* of the compressor 71 is connected to the refrigerating portion 62 via the low pressure valve 73. The pressure oscillator 61 generates pressure oscillations in the working fluid in the refrigerating portion 62 of the pulse tube refrigerator 60 by controlling the opening and closing of the high pressure valve 72 and the low pressure valve 73 at a predetermined timing. The maximum pressure Ph which is an output pressure of the compressor 71 is set at 2 MPa, and the minimum pressure P1 of an input pressure of the compressor 71 is set at 1 MPA.

The refrigerating portion 62 comprises a regenerator 74, a low temperature heat exchanger 75, a pulse tube 76 and a high temperature heat exchanger 77 connected in series, inline.

A hot end 74*a* of the regenerator 74 is connected to the pressure oscillator 61. A cold end 74*b* is connected to the low temperature heat exchanger 75. The regenerator 74 gradually refrigerates the working fluid while the working fluid moves therethrough towards the low temperature heat exchanger 75 side, and gradually heats the working fluid moving therethrough towards the pressure oscillator 61 side.

The low temperature heat exchanger 75 connected to the cold end 74*b* of the regenerator 74 generates a low temperature. In order to effectively remove the heat of a device to be refrigerated, such as an electronic device, in contact with the low temperature heat exchanger 75, the low temperature heat exchanger 75 is provided with a number of holes regularly formed along the flow direction of the working fluid.

The pulse tube 76 connected to the low temperature heat exchanger 75 is formed by a hollow tube having a cold end 76*a* on the low temperature heat exchanger 75 side and a hot end 76*b* on the high temperature heat exchanger 77 side. The pulse tube 76 is made of a material with low heat conductivity in order to prevent the transfer of the heat generated by the oscillation from the hot end 76*b* side to the low temperature heat exchanger side.

The high temperature heat exchanger 77 connected to the pulse tube 76 includes a number of holes regularly arranged along the flowing direction of the working fluid. The high temperature heat exchanger 77 refrigerates the hot end 76*b* side by releasing the heat of the working fluid flowing therethrough to outside thereof. The high temperature heat exchanger 77 is connected to the middle pressure buffer side valve 64.

The middle pressure buffer side valve 64 is provided between the high pressure heat exchanger 77 of the refrigerating portion 62 and the middle pressure buffer tank 63. A phase lag (phase difference) between pressure oscillation and displacement of the working fluid in the pulse tube 76 is adjusted by opening and closing the middle pressure buffer side valve 64 at a predetermined timing. The volume of the middle pressure buffer tank 63 is much larger than that of the refrigerating portion 62 of the pulse tube refrigerator 60. The pressure of the working fluid in the middle pressure buffer tank 63 is kept at an approximately average pressure (1.5 MPa) of the maximum pressure Ph (output pressure) and the minimum pressure P1 (input pressure) of the compressor 71.

Basic operation of the pulse tube refrigerator 60 will be explained as follows, referring to FIG. 5. Operation in one cycle of the pulse tube refrigerator 60 consists of four stages (a) to (d), explained as follows. Each stage is defined in accordance with the respective opening and closing condition of the high pressure valve 72, the low pressure valve 73 and the middle pressure buffer side valve 64.

FIG. 5 is a diagram showing the opening and the closing conditions of the high pressure valve 72, the low pressure valve 73 and the middle pressure buffer side valve 64, and the pressure condition in the pulse tube 76 at each stage (a) to (d) in one cycle of the pulse tube refrigerator 60. In FIG. 5, each bold line for the high pressure valve 72, the low pressure valve 73 and the middle pressure buffer side valve 64 respectively shows the opening condition, and each fine line shows the closing condition of the valves 72, 73, and 64. The operation of the pulse tube refrigerator at each stage (a) to (d) in one cycle will be explained as follows.

First stage (a) (First Half of Compression Stage)

The state in which the low pressure valve 73 is kept closed and the high pressure valve 72 is kept closed continuously from the previous stage (Second Half of Expansion Stage), whereas the middle pressure buffer control valve 64 is kept open. In this state, the pressure in the pulse tube 76 increases from the minimum pressure P1 to the average pressure Pm (the pressure in the middle pressure buffer tank 63).

Second stage (b) (Second Half of Compression Stage)

The state in which the middle pressure buffer side valve 64 is kept closed and the low pressure valve 73 is kept closed continuously from the previous stage (First Half of Compression Stage), whereas the high pressure valve 72 is kept open. In this state, the pressure in the pulse tube 76 increases from the average pressure Pm to the maximum pressure Ph.

Third stage (c) (First Half of Expansion Stage)

The state in which the high pressure valve 72 is kept closed and the low pressure valve 73 is kept closed continuously from the previous stage (Second Half of Compression Stage), whereas the middle pressure buffer side valve 64 is kept open. In this state, the pressure in the pulse tube 76 falls from the maximum pressure Ph to the average pressure Pm (the pressure in the middle pressure buffer 63). Accordingly, the reduction of the pressure causes the adiabatic expansion of the working fluid in the pulse tube 76 to lower the temperature.

Fourth stage (d) (Second Half of Expansion Stage)

The state in which the middle pressure buffer control valve 64 is kept closed and the high pressure valve 72 is kept closed continuously from the previous stage (First Half of Expansion Stage), whereas the low pressure valve 73 is kept open. In this state, the pressure in the pulse tube 76 falls from the average pressure Pm to the minimum pressure P1. Accordingly, the pressure decrease causes further adiabatic expansion of the working fluid in the pulse tube 76 to further lower the temperature.

The foregoing stages (a) to (d) comprise one cycle, and by repetition of this cycle the working fluid repeats movement towards one side to release the heat at the high temperature heat exchanger 77 and towards the other side to absorb the heat at the low temperature heat exchanger 75. The pulse tube refrigerator 60 thus generates a cryogenic temperature at the low temperature heat exchanger 75 of the refrigerating portion 62.

In the pulse tube refrigerator 60, the opening operation of the high pressure valve 72 at stage (b) and the opening operation of the low pressure valve 73 at stage (d) must be performed at a large pressure difference (the differential pressure between the maximum pressure Ph and the average pressure Pm or the differential pressure between the average pressure Pm and the minimum pressure P1). Accordingly, the losses generated due to the opening of the valves under different pressure condition, which is a thermodynamically irreversible process (valve loss), has been high. The generation of this high valve loss leads to an increase of the load of the compressor 71, which decreases the refrigeration efficiency of the pulse tube refrigerator 60.

Japanese Patent No. 2553822 addresses the irreversible process problem (the generation of the valve loss) due to the opening operation of the high pressure valve 72 and the low pressure valve 73. FIG. 6 is a block diagram of the pulse tube refrigerator disclosed in this Japanese Patent. As shown in FIG. 6, the pulse tube refrigerator 80 comprises a low pressure buffer tank 81, a low pressure buffer side valve 82, a high pressure buffer tank 83 and a high pressure buffer side valve 84, instead of the middle pressure buffer tank 63 and the middle pressure buffer side valve 64 included in the pulse tube refrigerator 60. Since the pressure oscillator 61 and the refrigerating portion 62 of the pulse tube refrigerator 80 and the pulse tube refrigerator 60 are identical, the same numerals are provided for the components thereof, and the explanation therefor will be omitted.

The low pressure buffer side valve 82 provided between the high temperature heat exchanger 77 of the refrigerating portion 62 and the low pressure buffer tank 81 adjusts the phase lag between the pressure oscillation and displacement of the working fluid in the pulse tube 76 of the pulse tube refrigerator 80 by opening and closing at a predetermined timing. The volume of the low pressure buffer tank 81 is much larger than that of the refrigerating portion 62 of the pulse tube refrigerator 80. The pressure of the working fluid in the low pressure buffer tank 81 is set to a minimum pressure P1 (1 MPa).

The high pressure buffer side valve 84 provided between the high temperature heat exchanger 77 of the refrigerating portion 62 and the high pressure buffer tank 83 adjusts the phase lag between the pressure oscillation and displacement of the working fluid in the pulse tube 76 of the pulse tube refrigerator 80 by opening and closing at a predetermined timing. The volume of the high pressure buffer tank 83 is much larger than that of the refrigerating portion 62 of the pulse tube refrigerator 80. The pressure of the working fluid in the high pressure buffer tank 83 is set to a maximum pressure Ph (2 MPa).

Basic operation of the pulse tube refrigerator 80 will be explained as follows, referring to FIG. 7 and FIG. 8. The operation of the pulse tube refrigerator 80 includes four stages (a) to (d) in one cycle, explained as follows. Each stage is defined in accordance with each opening and closing condition of the high pressure valve 72, the low pressure valve 73, the low pressure buffer side valve 82, and the high pressure buffer side valve 84.

FIG. 7 is a diagram showing opening and closing conditions of the high pressure valve 72, the low pressure valve 73, the low pressure buffer side valve 82 and the high pressure buffer side valve 84, and the pressure condition in the pulse tube 76. FIG. 8 is a schematic view showing the distribution (volume) of the working fluid In the pulse tube 76 at stages (a) to (d) respectively. In FIG. 7, each bold line for the high pressure valve 72, the low pressure valve 73, the low pressure buffer side valve 82 and the high pressure buffer side valve 84 shows each opening condition thereof, and each fine line shows each closing condition thereof. In FIG. 8, Numeral I represents a block of the working fluid flowing into and flowing out from the compressor 71 at the cold end 76*a* of the pulse tube 76. Numeral II represents a block of the working gas constantly present in the pulse tube 76 in one cycle and functioning as a gas piston therein. Numeral III represents a block of the working fluid flowing into and out from the low pressure buffer 81 at the hot end 76*b* of the pulse tube 76. Numeral IV represents a block of the working fluid flowing into and out from the high pressure buffer 83 at the hot end 76*b*. In FIG. 8, the volume of the working fluid represented as blocks I to IV at each stage (a) to (d) is calculated according to the result of a numerical analysis assuming that the working gas in the pulse tube 76 achieves a complete adiabatic change. Accordingly, the volume change of the working fluid blocks I to IV in one cycle is approximate to the actual moving volume of the working fluid. The operation of the pulse tube refrigerator 80 at each stage in one cycle will be explained as follows.

First stage (a) (Compression Stage)

The state in which the low pressure valve 73 and the low pressure buffer side valve 82 are kept closed and the high pressure valve 72 is kept closed continuously from the previous stage (Low Pressure Transfer Stage), whereas the high pressure buffer side valve 84 is kept open. In this state, the working fluid in the high pressure buffer tank 83 (block IV) maintained at the maximum pressure Ph flows into the pulse tube 76 through the hot end 76*b* via the high pressure buffer side valve 84. Since the high pressure buffer tank 83 and the pulse tube 76 are in communication with each other via the high pressure buffer side valve 84, the pressure in the pulse tube 76 promptly increases from the minimum pressure P1 to the maximum pressure Ph.

Second stage (b) (High Pressure Transfer Stage)

The state in which the high pressure valve 72 is kept open and the high pressure buffer side valve 84 is kept open continuously from the previous stage (Compression Stage), whereas the low pressure valve 73 and the low pressure buffer side valve 82 are both kept closed continuously from the previous stage (Compression Stage). In this state, the working fluid from the outlet port 71*a* of the compressor 71 (block I) which is the maximum pressure Ph flows into the pulse tube 76 through the cold end 76*a* via the high pressure valve 72. In this case, since the pressure of the working fluid in the high pressure buffer tank 83 is slightly lower than the maximum pressure Ph, because the working fluid in the high pressure buffer tank 83 flowed out to the pulse tube 76 at the previous stage, the working fluid from the high pressure buffer tank 83 (block IV) is forced to return to the high pressure buffer tank 83 by the working fluid in the block I.

Third stage (c) (Expansion Stage)

The state in which the high pressure valve 72 and the high pressure buffer control valve 84 are kept closed and the low pressure valve 73 is kept closed continuously from the previous stage (High Pressure Transfer Stage), whereas the low pressure buffer side valve 82 is kept open. Since the low pressure buffer tank 81, whose pressure is maintained at the minimum pressure P1, and the pulse tube 76 are in communication with each other via the low pressure buffer control valve 82 in this state, the pressure in the pulse tube 76 promptly falls from the maximum pressure Ph to the minimum pressure P1. The working fluid in the pulse tube 76 adiabatically expanded by this pressure decrease to lower the temperature. In this case, the working fluid from the low pressure buffer tank 81 (block III) returns to the low pressure buffer tank 81 through the hot end 76b of the pulse tube 76 via the low pressure buffer side valve 82.

Fourth stage (d) (Low Pressure Transfer Stage)

The state in which the low pressure valve 73 is kept open and the low pressure buffer side valve 82 is kept open continuously from the previous stage (Expansion Stage), whereas the high pressure valve 72 and the high pressure buffer side valve 84 are both kept closed continuously from the previous stage (Expansion Stage). In this state, the working fluid in the pulse tube 76 flown from the outlet port 71*a* of the compressor 71 at the previous stages (block I) is absorbed into the inlet port 71*b* of the compressor 71 via the low pressure valve 73. Since the pressure of the working fluid in the low pressure buffer tank 81 is slightly higher than the minimum pressure P1 because the working fluid in the pulse tube 76 flowed in the low pressure buffer tank 81 at the previous stage, the working fluid in the low pressure buffer tank 81 (block III) f lows into the pulse tube 76 through the hot end 76b via the low pressure buffer side valve 82. The working fluid (block I) moved to the low temperature heat exchanger 75 conducts heat exchange therewith, and the condition returns to stage (a).

The foregoing stages (a) to (d) comprise one cycle, and this cycle is repeated to generate a cryogenic temperature at the low temperature heat exchanger 75 of the refrigerating portion 62 in the pulse tube refrigerator 80.

In the pulse tube refrigerator 80, since the opening operations of the high pressure valve 72 and the low pressure valve 73 at stages (b) and (d) are performed under a small differential pressure, the valve losses at stages (b) and (d) are reduced. However, since the opening operation of the high pressure buffer side valve 84 at stage (a) and the opening operation of the low pressure buffer side valve 82 at stage (c) are required to be performed under a large differential pressure (the differential pressure between the maximum pressure Ph and the minimum pressure P1), the generation of valve losses is high at stages (a) and (c). The valve losses caused by the opening operation of the high pressure buffer side valve 84 and the low pressure buffer side valve 82 increase the loading of the compressor 71, which reduces the refrigeration efficiency of the pulse tube refrigerator 80.

As shown in FIG. 8, each moving volume of the working fluid of block I (stage (b) to (d)), block III (stage (c) to (d)) and block IV (stage (a) to (b)) becomes large. Accordingly, the load of the compressor 71 is increased due to the increased moving volume of the working fluid in block I, block III and block IV. For the large moving volume of the working fluid in block I, block III and block IV, the heat loss in the pulse tube 76 due to the entropy flowing into the cold end 76*a* from the hot end 76*b* of the pulse tube 76, and the regenerating heat loss due to the entropy flowing from the hot end 74*a* to the cold end 74*b*, without being accumulated at the regenerator 74 increases, which reduces the refrigerating efficiency of the pulse tube refrigerator 80. It has been confirmed by the inventors that the reduction of the refrigeration efficiency of the pulse tube refrigerator 80 due to the increase of the heat loss or the regenerating heat loss in the pulse tube 76 is high at cryogenic temperatures (less than or equal to 77 K).

The increase of the moving volume of the working fluid flowing into and out from the high pressure buffer tank 83 at the hot end 76*b* of the pulse tube 76 (block IV) at stages (a) and (b) has the following cause. While the high pressure buffer side valve 84 is kept open at stage (a), the pressure in the pulse tube 76 at the minimum pressure P1 is required to be increased to the maximum pressure Ph by further supplying working fluid thereto from the high pressure buffer tank 83. While the high pressure buffer side valve 84 and the high pressure valve 72 are kept open at stage (b), the working fluid (block IV) is required to be supplied to the high pressure buffer tank 83 from the compressor 71 in order to maintain the maximum pressure Ph in the high pressure buffer tank 83. Accordingly, the moving volume of the working fluid (block IV) is increased.

The moving volume of the working fluid flowing into and flowing out from the low pressure buffer tank 81 at the hot end 76*b* of the pulse tube 76 (block III) at stages (c) and (d) is increased by the same reason. Accompanying the increase of the moving volume of the working fluid (block III, block IV), the moving volume of the working fluid flowing into and out from the compressor 71 at the cold end 76*a* of the pulse tube 76 (block I) is increased at stages (b) to (d).

SUMMARY OF THE INVENTION

Accordingly, an object of this invention is to reduce a valve losses in each cycle, to improve refrigeration efficiency of the pulse tube refrigerator.

To solve the foregoing problems, the pulse tube refrigerator of this invention includes a refrigerating portion comprising a regenerator, a low temperature heat exchanger, a pulse tube and a high temperature heat exchanger connected in series, inline. A pressure oscillator has a compressor, a high pressure valve and a low pressure valve, and generates pressure oscillations of the working fluid in the pulse tube by connecting an output port and an inlet port of the compressor to the regenerator via the high pressure valve and the low pressure valve respectively. A plurality of buffer tanks each have a different middle pressures level between the output pressure and the input pressure of the compressor, and are connected to the high temperature heat exchanger via respective buffer side valves for adjusting a phase lag between the pressure oscillation and displacement of the working fluid in the pulse tube.

Since a plurality of buffer tanks, each having a different pressure level predetermined as the middle pressures between the output pressure and the input pressure of the compressor, are connected to the high temperature heat exchanger via respective buffer side valves, when the opening state of each buffer side valve, the high pressure valve and the low pressure valve are arranged not to overlap one another in the order of a predetermined pressure controlling process (ascending, descending order) during the refrigeration cycle, each stage of the cycle is performed with a relatively small differential pressure between adjacent middle pressures. In consequence, the moving volume of the working fluid flowing into and out from the compressor at the cold end of the pulse tube, and the moving volume of the working fluid flowing into and out from each buffer tank at the hot end of the pulse tube, are reduced respectively in order to generate a predetermined pressure condition. Due to the reduction of the moving volume of the working fluid, the load of the compressor is reduced.

Due to the reduction of the moving volume of the working fluid, the heat loss in the pulse tube due to entropy flowing from the hot end towards the cold end of the pulse tube, and the regenerating heat loss due to entropy flowing from the hot end to the cold end without being reserved in the regenerator, are greatly reduced, which improves the refrigeration efficiency of the pulse tube refrigerator.

Due to the reduction of the moving volume of the working fluid, the volume size required for each buffer tank is reduced.

The valve losses due to the opening operation of the control valve under different pressure conditions, which is a thermodynamically irreversible process, are reduced as a whole by performing the opening operation of the control valves of each buffer, the compressor high pressure control valve and the compressor low pressure control valve under a relatively small differential pressure, which reduces the dynamic force load of the compressor.

In another aspect of the pulse tube refrigerator of this invention, the pulse tube refrigerator has two buffer tanks (a first buffer tank and a second buffer tank). Since two buffer tanks are provided, the volume size required for each buffer tank is reduced, to achieve a size reduction of the pulse tube refrigerator as a whole, while adding a minimum number of buffer tanks.

In a further aspect of the invention, the buffer tanks having a first middle pressure and a second middle pressure respectively comprise a first middle pressure buffer tank connected to the high temperature heat exchanger via a first middle pressure buffer side valve and a second middle pressure buffer tank connected to the high temperature heat exchanger via a second middle pressure buffer side valve. The high pressure valve, the low pressure valve, the first middle pressure buffer side valve and the second middle pressure buffer side valve are opened in the order of a predetermined pressure controlling process. Opening conditions of the high pressure valve, the low pressure valve, the first middle pressure buffer side valve and the second middle pressure buffer side valve are predetermined not to overlap one another.

Accordingly, each stage of a cycle is performed under the relatively small differential pressures of adjacent different middle pressures. In consequence, the moving volume of the working fluid flowing into and out from the compressor at the hot end of the pulse tube, and the moving volume of the working fluid flowing into and out from the first and the second middle pressure buffer tank at the hot end of the pulse tube, are reduced. Due to the reduction of the moving volume of the working fluid, the load of the compressor is reduced.

The heat loss and the regenerating heat loss in the pulse tube is greatly reduced by the reduction of the moving volume of the working fluid, and the refrigeration efficiency of the pulse tube refrigerator is improved.

The volume size required for the first and the second middle pressure buffer tanks is reduced by the reduction of the moving volume of the working fluid, which achieves a size reduction of the pulse tube refrigerator.

By opening the high pressure valve, the low pressure valve, the first middle pressure buffer side valve and the second middle pressure buffer side valve under the relatively small differential pressure, the valve losses are reduced as a whole, and the driving force required for the compressor is reduced.

According to a still further aspect of this invention, the pulse tube refrigerator includes a pulse tube having a hot end and a cold end, the compressor being in fluid communication with the cold end of the pulse tube, the first pressure buffer tank having the first pressure being in communication with the hot end of the pulse tube and the second pressure buffer tank having the second pressure being in communication with the hot end of the pulse tube. A working fluid includes a first gas block (block I) flowing into and out from the compressor at the cold end of the pulse tube, a second gas block (block III) functioning as a gas piston is constantly present in the pulse tube, a third gas block (block III) flowing into and out from the first pressure buffer tank at the hot end of the pulse tube and a fourth gas block (block IV) flowing into and out from the second pressure buffer tank at the hot end of the pulse tube. Means are provided for reducing the moving volume of the first gas block, the third gas block and the fourth gas block by reducing the differential pressure at each stage of the refrigeration cycle. The load of the compressor is thereby reduced.

Reduction of the moving volume of the first gas block, the third gas block, and the fourth gas block largely reduces the heat loss and the regenerating heat loss in the pulse tube, which improves the refrigeration efficiency of the pulse tube refrigerator.

Reduction of the moving volume of the first gas block, the third gas block, and the fourth gas block reduces the volume size required for the first and the second pressure buffer, which reduces the size of the pulse tube refrigerator.

Since the differential pressure at each stage in the refrigeration cycle is reduced, each valve provided with the pulse tube refrigerator is opened under a relatively small differential pressure, which reduces the valve losses as a whole, to reduce the driving force required for the compressor.

BRIEF DESCRIPTION OF THF DRAWINGS

These and other objects and features of the invention will be more apparent and more readily appreciated from the following detailed description of the preferred embodiment of the invention with the accompanying drawings, in which.

DETAILED DESCRIPTION OF THE PREFERRED EMBODIMENTS

Figure 1:
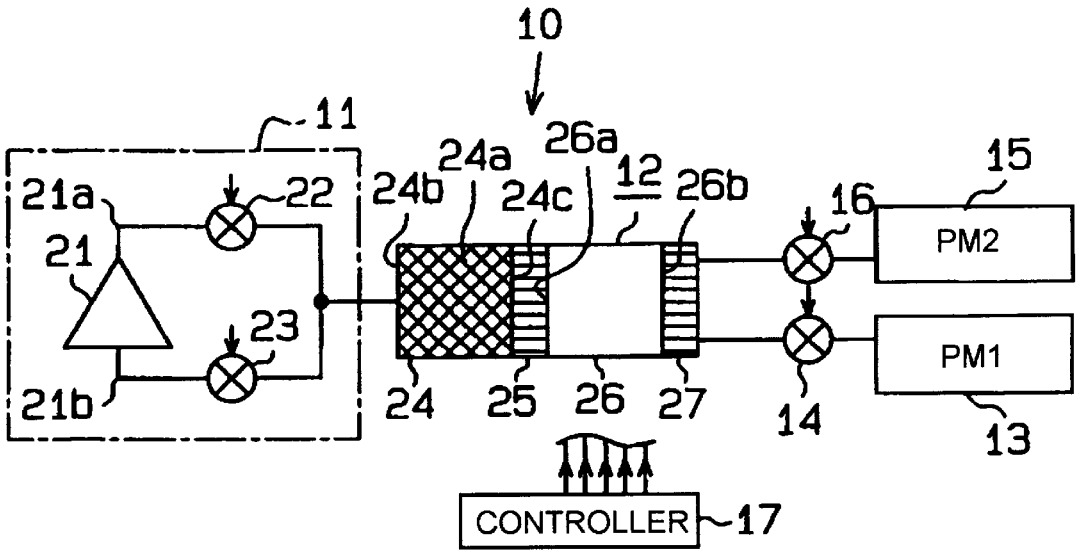
FIG. 1 is a block schematic diagram showing an embodiment of a pulse tube refrigerator according to this invention.

An embodiment of a pulse tube refrigerator of this invention is described as follows referring to FIGS. 1 through 3. As shown in FIG. 1, a pulse tube refrigerator 10 of this embodiment comprises a pressure oscillator 11, a refrigerating portion 12, a first middle pressure buffer tank 13, a first middle pressure buffer side valve 14, a second middle pressure buffer tank 15, a second middle pressure buffer side valve 16 and a controller 17.

The refrigerator 12 includes a regenerator 24, a low temperature heat exchanger 25, a pulse tube 26 and a high temperature heat exchanger 27 connected in series, inline. The regenerator 24, filled with a regenerative material 24*a* structured with a mesh made of a material such as stainless steel or phosphor bronze, includes a hot end 24*b* and a cold end 24*c*. The hot end 24*b* is connected to the pressure oscillator 11 and the cold end 24*c* is connected to the low temperature heat exchanger 25. The regenerator 24 exchanges heat with the working fluid. The working fluid is refrigerated when it moves towards the low temperature heat exchanger 25 side, and is heated when it moves towards the pressure oscillator 11 side.

The low temperature heat exchanger 25 connected to the cold end 24*c* of the regenerator 24 generates a low temperature. In order to effectively remove heat from a device to be refrigerated by contacting thereto, the low temperature heat exchanger 25 is formed, for instance, with a number of regularly arranged holes along the flow direction of the working fluid or is made of a material with high heat conductivity such as bronze.

The pulse tube 26 connected to the low temperature heat exchanger 25 is a hollow tube having a cold end 26*a* and a hot end 26*b* on the low temperature heat exchanger 25 side and on the high temperature heat exchanger 27 side, respectively. In order to prevent heat transfer from the hot end 26*b* side to the low temperature heat exchanger 25, the pulse tube 26 is made of the material with low heat conductivity such as stainless steel.

The high temperature heat exchanger 27 connected to the pulse tube 26 is formed, for example, with a number of regularly arranged holes along the flow direction of the working fluid and is made of copper. The high temperature heat exchanger 27 refrigerates the hot end 26*b* side of the pulse tube by releasing the heat of the working fluid flowing therethrough. The high temperature heat exchanger 27 is connected to a first middle pressure buffer side valve 14 and to a second middle pressure buffer side valve 16.

The pressure oscillator 11, including a compressor 21, a high pressure valve 22 and a low pressure valve 23, generates pressure oscillations in the working fluid such as helium filled in the refrigeration portion 12 of the pulse tube refrigerator 10. An outlet port 21*a* of the compressor 21 is connected in fluid communication with the regenerator 24 via the high pressure valve 22. An inlet port 21*b* of the compressor 21 is connected in communication with the regenerator 24 via the low pressure valve 23. Opening and closing of the high pressure valve 22 and the low pressure valve 23 are controlled by the controller 17 at a predetermined timing. The pressure oscillator 11 generates pressure oscillations in the working fluid in the refrigerating portion 12 of the pulse tube refrigerator 10 by controlling the valves 22 and 23. In this embodiment, the maximum pressure Ph (which is an output pressure of the compressor 21) is set as 2 MPa and the minimum pressure P1 (which is an input pressure of the compressor 21) is set as 1 Mpa.

The first middle pressure buffer side valve 14, provided between the high temperature heat exchanger 27 of the refrigerating portion 12 and the first middle pressure buffer tank 13, adjusts the phase lag between the pressure oscillation and displacement of the working fluid in the pulse tube 26 by opening and closing at a predetermined timing by the controller 17. The capacity of the first middle buffer tank 13 is larger than that of the refrigerating portion 12. The pressure of the working fluid in the first middle pressure buffer 13 is predetermined as a first middle pressure Pm1 which is 1.33 MPa, that is, it is set to P1+0.33 (Ph−P1).

The second middle pressure buffer side valve 16 is provided between the high temperature heart exchanger 27 of the refrigerating portion 12 and the second middle pressure buffer tank 15. The second middle pressure buffer side valve 16 adjusts the phase lag of the pressure oscillation and displacement of the working fluid in the pulse tube 26 by opening and closing at a predetermined timing by the controller 17. The capacity of the second middle buffer tank 15 is approximately the same as that of the first middle pressure buffer tank 13. The pressure of the working fluid in the second middle pressure buffer 15 is predetermined as a second middle pressure Pm2 which is 1.67 MPa, that is, it is set to P1+0.67 (Ph−P1).

The controller 17 controls the high pressure valve 22, the low pressure valve 23, the first middle pressure buffer side valve 14 and the second middle pressure buffer side valve 16 at a predetermined timing, respectively. These valves 22, 23, 14, 16, and the controller may be constructed as a rotary valve unit having a rotor, a stator and a motor that drives the rotor.

The operation of the pulse tube refrigerator 10 of this embodiment will be explained with reference to FIG. 2 and FIG. 3. The operation of the pulse tube refrigerator 10 has six stages in one cycle. Each stage is determined in accordance with the respective opening and closing condition of the high pressure valve 22, the low pressure valve 23, the first middle pressure buffer side valve 14 and the second middle pressure buffer side valve 16.

Figure 2:
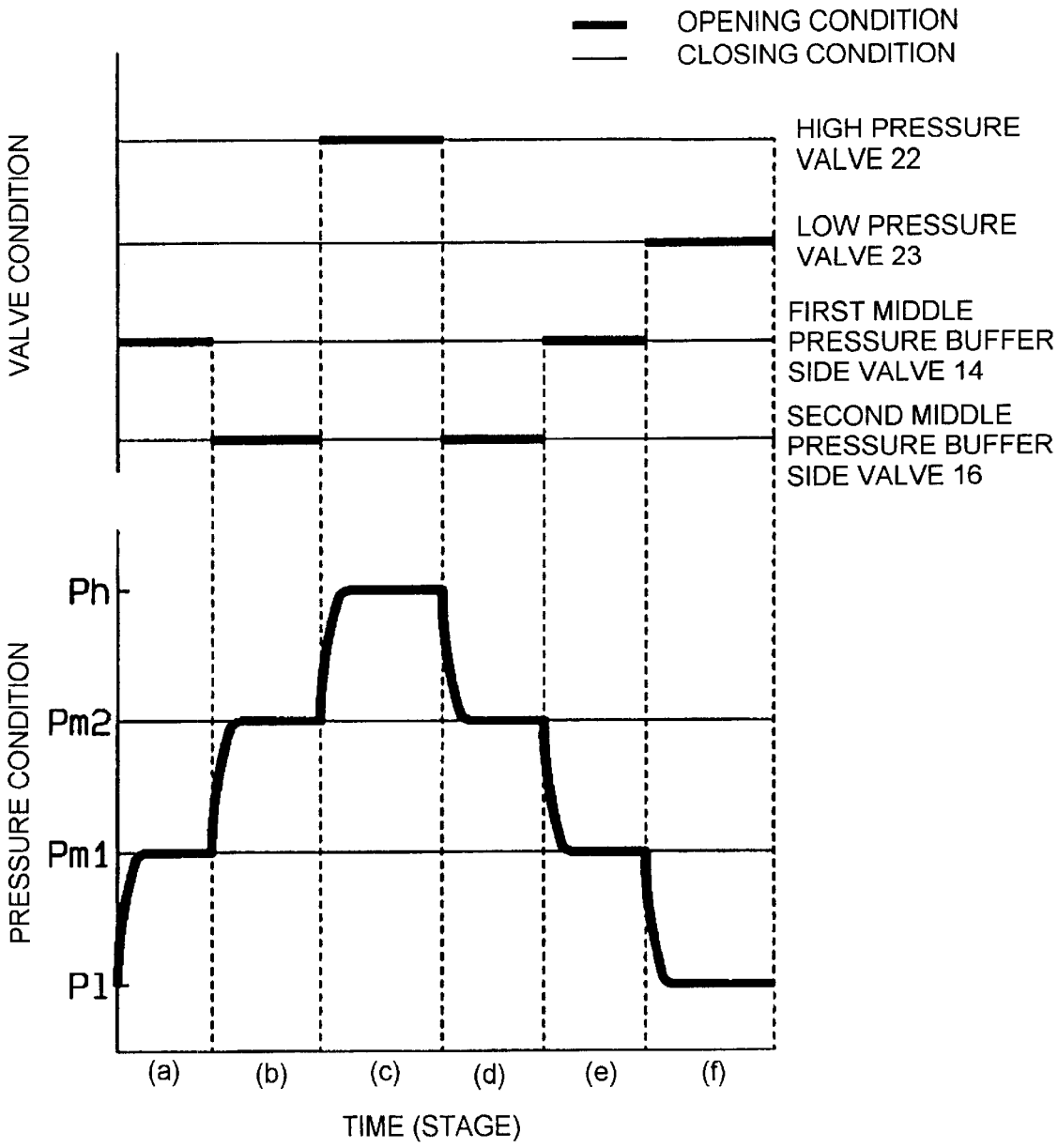
FIG. 2 shows a diagram illustrating operation conditions of each valve and the pressure conditions of the pulse tube in accordance with the conditions of the valve of this embodiment of the invention.
Figure 3:
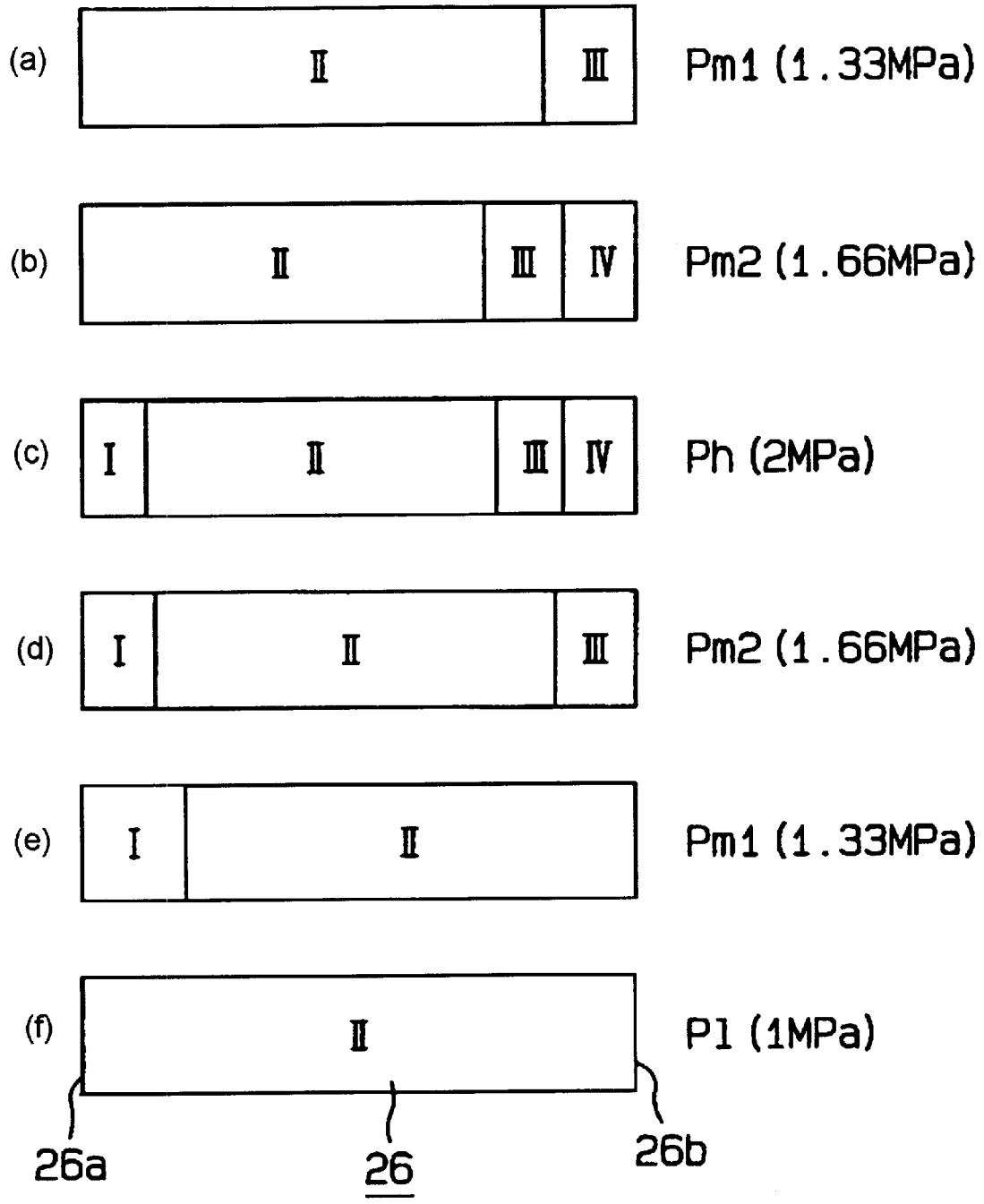
FIG. 3 is a schematic view showing the distribution of working fluid of the embodiment of this invention.
Figure 4:
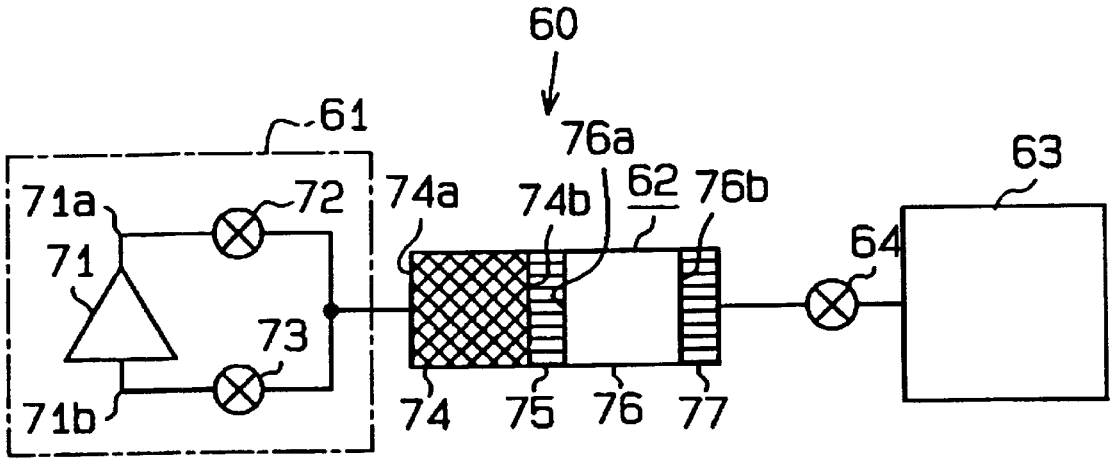
Fig.4 PRIOR ART
FIG. 4 is a block schematic diagram illustrating a first conventional pulse tube refrigerator.
Figure 5:
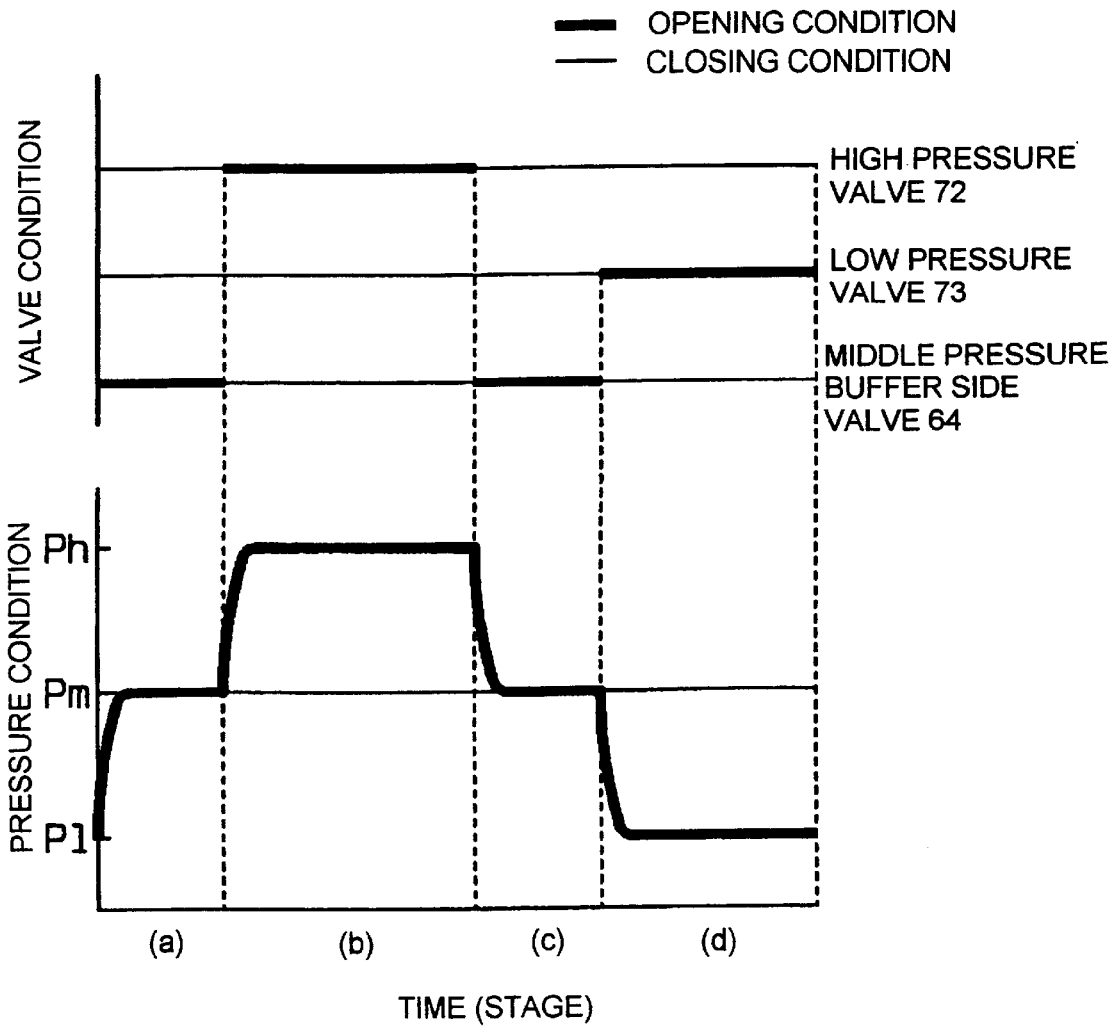
Fig.5 PRIOR ART
FIG. 5 shows a diagram showing operation conditions of each control valve and the pressure conditions of the pulse tube according to the first conventional pulse tube refrigerator.

FIG. 2 is a diagram showing the opening and closing condition of the high pressure valve 22, the low pressure valve 23, the first middle pressure buffer side valve 14 and the second middle pressure buffer side valve 16, and the pressure condition in the pulse tube 26 at each stage (at stages (a) to (f)) in one cycle. FIG. 3 is a schematic view showing the distribution (volume) of the working fluid in the pulse tube 26 at each stage (at stages (a) to (f)). In FIG. 2, each bold line for the high pressure valve 22, the low pressure valve 23, the first middle pressure buffer side valve 14, and the second middle pressure buffer side valve 16 shows each opening condition thereof. Each fine line shows the closed condition of each valve. In FIG. 3, numeral I indicates a block of the working fluid flowing into and out from the compressor 21 at the cold end 26*a* of the pulse tube 26. Numeral II indicates a block of the working fluid constantly present in the pulse tube 26 and functioning as a gas piston therein. Numeral III indicates a block of the working fluid flowing into and out from the first middle pressure buffer tank 13 at the hot end 26*b* of the pulse tube 26. Numeral IV indicates a block of the working fluid flowing into and out from the second middle pressure buffer tank 15 at the hot end 26*b* of the pulse tube 26. In FIG. 3, the distribution of the working fluid indicated by blocks I to IV in stages (a) to (f) is illustrated according to the result quantitatively obtained from a numerical analysis assuming that the working fluid in the pulse tube 26 achieves a complete adiabatic change. Accordingly, the change of the distribution of the blocks I to IV of the working fluid in one cycle is approximate to the actual moving volume of the working fluid. The operation of the pulse tube refrigerator 10 in one cycle will be explained as follows.

First stage (a) (First Stage of Compression Stage)

The state in which the low pressure control valve 23 is kept closed and the high pressure valve 22 and the second middle pressure buffer side valve 16 are kept closed continuously from the previous stage (Third Stage of Expansion Stage), whereas the first middle pressure buffer side valve 14 is kept open. In this state, the working fluid in the first middle pressure buffer tank 13 (block III) maintained at the first middle pressure Pm1 flows into the pulse tube 26 through the hot end 26*b* via the first middle pressure buffer side valve 14. In this case, since the first middle pressure buffer tank 13 and the pulse tube 26 are in communication with each other via the first middle pressure buffer side valve 14 with relatively low pressure loss, the pressure in the pulse tube 26 promptly increases from the minimum pressure P1 to the pressure of the first middle pressure buffer 13 (the first middle pressure Pm1).

Second stage (b) (Second Stage of Compression Stage)

The state in which the first middle pressure buffer side valve 14 is kept closed and the high pressure valve 22 and the low pressure valve 23 are kept closed continuously from the previous stage (First Stage of Compression Stage), whereas the second middle pressure buffer side valve 16 is kept open. In this state, the working fluid in the second middle pressure buffer tank 15 (block IV) maintained at the second middle pressure Pm2 flows into the pulse tube 26 through the hot end 26*b* via the second middle pressure buffer side valve 16. In this case, since the second middle pressure buffer tank 15 and the pulse tube 26 are in communication with each other via the second middle pressure buffer side valve 16 with relatively low pressure loss, the pressure in the pulse tube 26 is promptly increased from the first middle pressure Pm1 to the second middle pressure Pm2 (the pressure of the second middle pressure buffer tank 15).

Third stage (c) (Third Stage of Compression Stage)

The state in which the second pressure buffer side valve 16 is kept closed and the low pressure valve 23 and the first middle pressure buffer side valve 14 are kept closed continuously from the previous stage (Second Stage of Compression Stage), whereas the high pressure valve 22 is kept open. In this state, the working fluid from the outlet port 21*a* of the compressor 21 which is the maximum pressure Ph flows into the pulse tube 26 through the cold end 26*a* via the high pressure valve 22 and the pressure in the pulse tube 26 is promptly increased to the maximum pressure Ph.

Fourth stage (d) (First Stage of Expansion Stage)

The state in which the high pressure valve 22 is kept closed and the low pressure valve 23, and the first middle pressure buffer side valve 14 are kept closed continuously from the previous stage (Third Stage of Compression Stage), whereas the second middle pressure buffer side valve 16 is kept open. In this state, the working fluid from the second middle pressure buffer tank 15 flown into the pulse tube 26 (block IV) returns to the second middle pressure buffer tank 15 through the hot end 26*b* via the second middle pressure buffer side valve 16. In this case, since the second middle pressure buffer tank 15 and the pulse tube 26 are in communication with each other via the second middle pressure buffer side valve 16 which causes less pressure loss, the pressure in the pulse tube 26 is promptly decreased from the maximum pressure Ph to the second middle pressure Pm2 (the pressure of. the second middle pressure buffer 15). As a result of this pressure decrease, the working fluid in the pules tube 26 is adiabatically expanded to lower the temperature thereof.

Fifth stage (e) (Second Stage of Expansion Stage)

The state in which the second middle pressure buffer side valve 16 is kept closed and the high pressure valve 22 and the low pressure valve 23 are kept closed continuously from the previous stage (First Stage of Expansion Stage), whereas the first middle pressure buffer side valve 14 is kept open. In this state, the working fluid from the first middle pressure buffer tank 13 flown into the pulse tube 26 (block III) returns to the first middle pressure buffer tank 13 through the hot end 26*b* via the first middle pressure buffer side valve 14. In this case, since the first middle pressure buffer tank 13 and the pulse tube 26 are in communication with each other via the first middle pressure buffer side valve 14 which causes less pressure loss, the pressure in the pulse tube 26 is promptly decreased from the second middle pressure Pm2 to the first middle pressure Pm1 which corresponds to the pressure in the first middle pressure buffer 13. As a result of this decrease of the pressure, the working fluid in the pulse tube 26 is further adiabatically expanded to lower the temperature thereof.

Sixth stage (f) (Third Stage of Expansion Stage)

The state in which the first middle pressure buffer side valve 14 is kept closed and the high pressure valve 22 and the second middle pressure buffer side valve 16 are kept closed continuously from the previous stage (Second Stage of Expansion Stage), whereas the low pressure valve 23 is kept open. In this state, the working fluid in the pulse tube 26 flown from the outlet port 21*a* of the compressor 21 (block I) is flown into the inlet port 21*b* of the compressor 21 via the low pressure valve 23 and the pressure in the pulse tube 26 is promptly decreased to the minimum pressure P1. As a result of the movement of the working fluid (block 1) to the low temperature heat exchanger 25, heat is exchanged between the working fluid and the low temperature heat exchanger 25 to return to the state of the stage (a).

The foregoing Stages (a) to (f) comprise one cycle, and this cycle is repeated to generate condition changes in the working fluid as is illustrated as block I to IV, which generates the cryogenic temperature at the low temperature heat exchanger 25 of the pulse tube refrigerator 10. According to the embodiment as described above, the following effects are obtained.

(1) The opening condition of the first middle pressure buffer side valve 14, the second middle pressure buffer side valve 16, the high pressure valve 22 and the low pressure valve 23 do not overlap one another at each stage and are arranged in the order of a predetermined pressure controlling process (ascending, descending order). For example, the low pressure valve 23, the first middle pressure buffer side valve 14, the second middle pressure buffer side valve 16 and the high pressure valve 22 are controlled to open in this order (the low pressure valve 23 is opened in stage (f), next the first middle pressure buffer side valve 14 is opened in stage (a), next the second middle pressure buffer side valve 16 is opened in stage (b), next the high pressure valve 22 is opened in stage (c)). Further, the high pressure valve 22, the second middle pressure buffer side valve 16, the first middle pressure buffer side valve 14 and the low pressure valve 23 are controlled to open in this order (the high pressure valve 22 is opened in stage (c), next the second middle pressure buffer side valve 16 is opened in stage(d), next the first middle pressure buffer side valve 14 is opened in stage(e), and next the low pressure valve 23 is opened in stage (f)). Each stage in one cycle is conducted under a relatively small pressure difference (0.33 MPa). Accordingly, as shown in FIG. 3, the moving volume of the working gas, the block I in stages (c) to (f) (the block III in stages (a) to (e), and the block IV in stages (b) to (d)) can be reduced respectively. It has been confirmed by the inventors that the moving volume of the working fluid (the blocks 1, III, IV), corresponds to approximately a third of that of the conventional pulse tube refrigerator 80 shown in FIG. 6. Due to the reduction of the moving volume of the working fluid (the blocks I, III, IV), the load of the compressor 21 can be reduced. Since the high load condition in which the efficiency of the compressor 21 drops is avoided, the efficiency of the compressor 21 can be improved.

By the reduction of the moving volume of the working fluid (the blocks I, II, IV), the heat loss in the pulse tube 26 according to the entropy from the hot end 26*b* to the cold end 26*a* of the pulse tube 26, and the regenerating heat loss according to the entropy not to be stored in the regenerator 24 and flowing from the hot end 24*b* to the cold end 24*c*, can be sharply reduced, which improves the refrigerating efficiency of the pulse tube refrigerator 10. It has been confirmed by the inventors that the improvement of the refrigerating efficiency of the pulse tube refrigerator 10 by the reduction of the heat loss and the regenerating heat loss in the pulse tube 26 is high, particularly at cryogenic temperatures (less than 77k).

Figure 6:
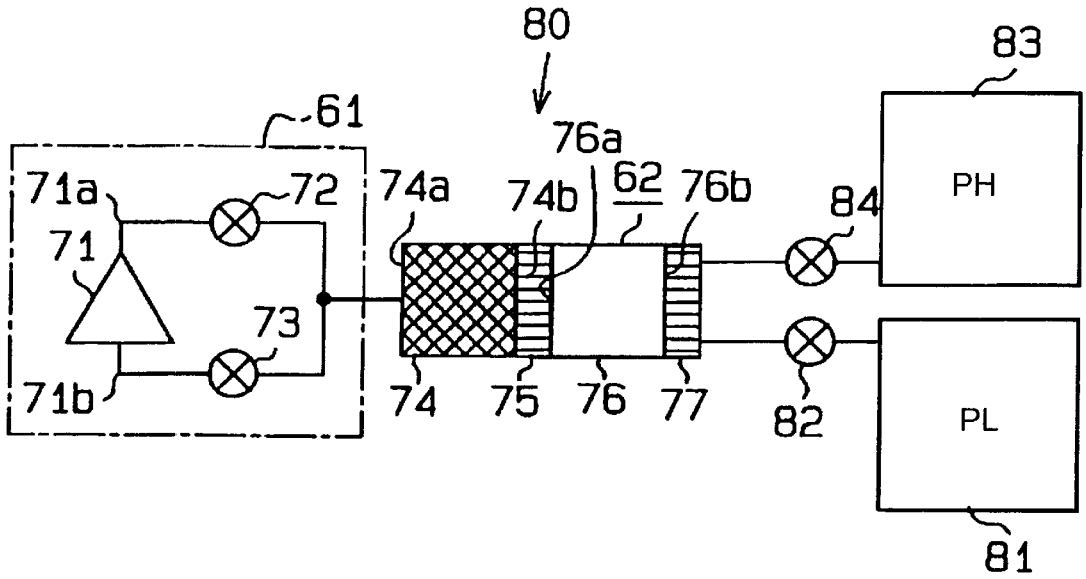
Fig.6 PRIOR ART
FIG. 6 is a block schematic diagram showing a second conventional pulse tube refrigerator.
Figure 7:
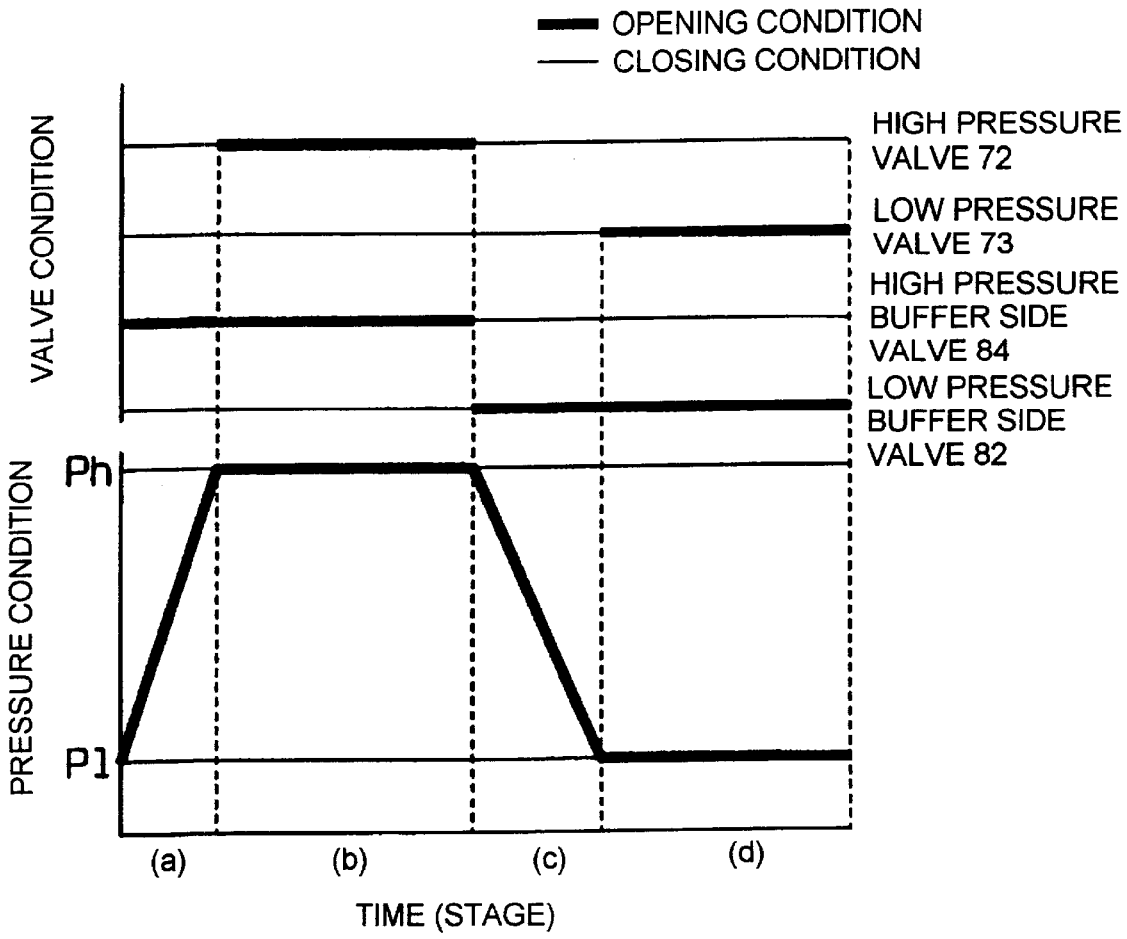
Fig.7 PRIOR ART
FIG. 7 shows a diagram illustrating operation conditions of each control valve and the pressure conditions of the pulse tube according to the second conventional pulse tube refrigerator.
Figure 8:
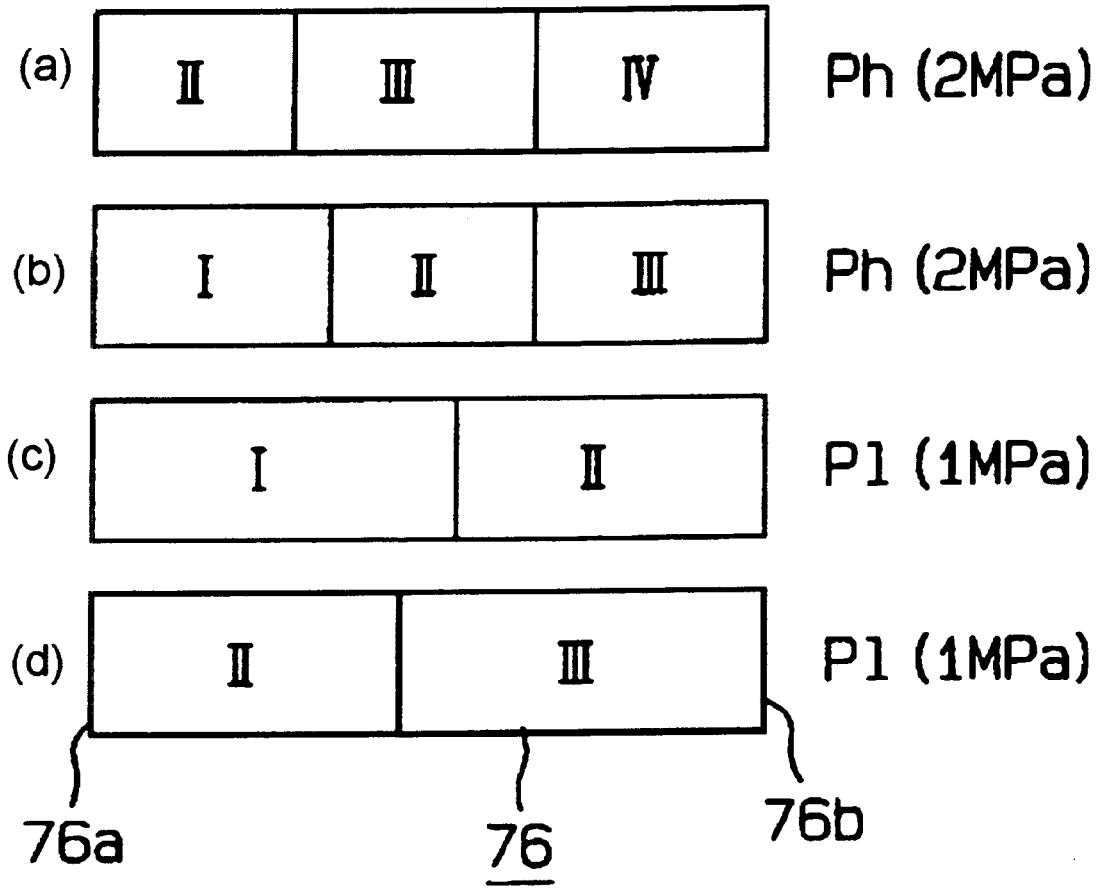
Fig.8 PRIOR ART
FIG. 8 is a schematic view showing a distribution of the working fluid of the second conventional pulse tube refrigerator.

By the reduction of the moving volume of the working fluid (the block III, IV) from the first and the second middle pressure buffer tank 13, 15, the volume size of the first and the second middle pressure buffer tank 13, 15 can be reduced to a third of that of the conventional pulse tube refrigerator 80 shown in FIG. 6, which reduces the size of the pulse tube refrigerator as a whole.

(2) In this embodiment, the opening condition of the first middle pressure buffer side valve 14, the second middle pressure buffer side valve 16, the high pressure valve 22 and the low pressure valve 23 are defined not to overlap one another at each stage and are arranged in the order of the predetermined pressure controlling process (ascending, descending order). Each stage in one cycle is conducted under a relatively small pressure difference (0.33 MPa). Accordingly, the loss according to the opening of control valve under different pressure conditions, which is a thermodynamically irreversible process (valve loss), can be reduced as a whole. This enables a reduction in the load of the compressor 21.

The invention is not limited to the foregoing embodiment and can be arranged as follows. The first middle pressure buffer side valve 14, the second middle pressure buffer side valve 16, the high pressure valve 22 and the low pressure valve 23 are arranged to be switched simultaneously at each stage (a) to (f), so that the opening conditions thereof are not overlapped in the foregoing embodiment. However, a timing providing an overlap of opening of the control valves or a time lag for switching the control valves is also within the scope of this invention.

The opening and closing condition (shown FIG. 2) of the first and the second middle pressure buffer side valve 14, 16, the high pressure valve 22, and the low pressure valve 23 at each stage (a) to (f) in one cycle of the aforementioned embodiment shows an example. Other opening and closing conditions can be adopted as long as the change of the distribution of the working fluid (the reduction of the moving volume of the working fluid) illustrated as the block I to IV as shown in FIG. 3 is achieved in one cycle.

The predetermined pressure at the first and the second middle pressure buffer tanks 13, 15 adopted in the foregoing embodiment are an example. The predetermined pressures in the first and the second middle pressure buffer tanks 13, 15 may be different, so long as the predetermined pressures are between the maximum pressure Ph and the minimum pressure P1.

In the foregoing embodiment, the buffer tanks (the first middle pressure buffer tank 13 and the second middle pressure buffer tank 15) have different pressures therebetween, and the pressures are determined to be between the maximum pressure Ph and the minimum pressure P1. However, other buffer tanks (a first pressure buffer tank and a second pressure buffer tank) having different pressures therebetween can be adopted as long as the distribution change of the working fluid illustrated as the blocks I to IV (the reduction of the moving volume of the working fluid) as shown in FIG. 3 and appropriately controlling the opening and closing control valves provided on the pulse tube refrigerator is achieved.

Although the opening and closing condition of the first and the second middle pressure buffer side valve 14, 16, the high pressure valve 22 and the low pressure valve 23 are fixedly repeated in the foregoing embodiment, the different opening and closing conditions at the starting of operation and during the operation of the pulse tube refrigerator 10 can be predetermined.

Although two buffer tanks (the first and the second middle pressure buffer tank 13, 15) having the pressures between the maximum pressure Ph and the minimum pressure P1 are arranged in the foregoing embodiment, the number of buffer tanks can be more than two as long as the buffer tanks have different middle pressures. In this case, the same effect can be obtained by arranging the opening condition of the valves for each buffer tank not to overlap one another and arranging the valves in the order of the predetermined pressure controlling process.

The first and the second middle pressure buffer side valves 14, 16, the high pressure valve 22 and the low pressure valve 23 in the foregoing embodiment can be arranged separately for controlling the opening and the closing respectively. A plurality of valves can be arranged as one rotary valve unit to control opening and the closing simultaneously by the rotation of the rotor.

As the working fluid of the foregoing embodiment, helium, neon, argon, nitrogen, air and a combination thereof can be adopted.

It is intended that the foregoing detailed description be regarded as illustrative rather than limiting and that it is understood that the following claims including all equivalents are intended to define the scope of the invention.

What is claimed is:

1. A pulse tube refrigerator comprising:

a refrigerating portion including a regenerator, a low temperature heat exchanger, a pulse tube and a high temperature heat exchanger connected in series;

a pressure oscillator including a compressor, a high pressure valve and a low pressure valve for generating pressure oscillations of a working fluid in a pulse tube by connecting an outlet port and an inlet port of the compressor to the regenerator via the high pressure valve and the low pressure valve, respectively;

a plurality of buffer tanks having different middle pressure levels between an output pressure and an input pressure of the compressor, wherein each of said buffer tanks is connected to the high temperature heat exchanger via a buffer side valve; and a controller configured to arrange an opening condition of the high pressure valve, the low pressure valve and the buffer side valve so as not to overlap one another.

2. A pulse tube refrigerator according to claim 1, wherein the plurality of buffer tanks comprises a first buffer tank and a second buffer tank.

3. A pulse tube refrigerator according to claim 2, wherein the first buffer tank has a first middle pressure and is connected to the high temperature heat exchanger via a first middle pressure buffer side valve, and wherein the second buffer tank has a second middle pressure higher than the first middle pressure and is connected to the high temperature heat exchanger via a second middle pressure buffer side valve.

4. A pulse tube refrigerator according to claim 3, wherein said controller is connected to the high pressure valve, the first middle pressure valve, the second middle pressure valve and the low pressure valve, and configured to control opening of the high pressure valve, the first middle pressure valve, the second middle pressure valve and the low pressure valve such that the high pressure valve, the first middle pressure valve, the second middle pressure valve and the low pressure valve are opened in order of a predetermined pressure controlling process.

5. A pulse tube refrigerator according to claim 1, wherein said controller is connected to the high pressure valve, the first middle pressure valve, the second middle pressure valve and the low pressure valve, and configured to control opening of the high pressure valve, the first middle pressure valve, the second middle pressure valve and the low pressure valve such that the high pressure valve, the first middle pressure valve, the second middle pressure valve and the low pressure valve are opened and closed so as to raise the pressure in the pulse tube step by step during compression stages in refrigeration cycle.

6. A pulse tube refrigerator according to claim 1, wherein said controller is connected to the high pressure valve, the first middle pressure valve, the second middle pressure valve and the low pressure valve, and configured to control opening of the high pressure valve, the first middle pressure valve, the second middle pressure valve and the low pressure valve such that the high pressure valve, the first middle pressure valve, the second middle pressure valve and the low pressure valve are opened and closed so as to lower the pressure in the pulse tube step by step during expansion stages in refrigeration cycle.

7. A pulse tube refrigerator according to claim 3, where in the low pressure valve the first middle pressure buffer side valve, the second middle pressure buffer side valve, and the high pressure valve are controlled to open in this order.

8. A pulse tube refrigerator according to claim 3, wherein the high pressure valve, the second middle pressure buffer side valve, the first middle pressure buffer side valve, and the low pressure valve are controlled to open in this order.

9. A pulse tube refrigerator according to claim 7, wherein an opening condition of the low pressure valve, the first middle pressure buffer side valve, the second middle pressure buffer side valve and the high pressure valve are arranged not to overlap one another.

10. A pulse tube refrigerator according to claim 8, wherein opening condition of the high pressure valve, the second middle pressure buffer side valve, the first middle pressure buffer side valve, and the low pressure valve are arranged not to overlap one another.

11. A pulse tube refrigerator comprising:

a pulse tube having a cold end and a hot end;

a compressor in fluid communication with the cold end of the pulse tube;

a first pressure buffer having a first pressure and in communication with the hot end of the pulse tube; and a second pressure buffer having a second pressure different from the first pressure and in communication with the hot end of the pulse tube; wherein a working fluid includes a first gas block flowing into and out from the compressor at the cold end of the pulse tube, a second gas block functioning as a gas piston and always present in the pulse tube, a third gas block flowing into and out from the first pressure buffer at the hot end of the pulse tube and a fourth gas block flowing into and out from the second pressure buffer at the hot end of the pulse tube, and wherein moving volume reduction means for reducing moving volumes of the first gas block, the third gas block and the fourth gas block by reducing a differential pressure at each stage in a refrigeration cycle.

12. A pulse tube refrigerator comprising:

a refrigerating portion including a regenerator, a low temperature heat exchanger, a pulse tube and a high temperature heat exchanger connected in series;

a pressure oscillator including a compressor, a high pressure valve and a low pressure valve for generating pressure oscillations of a working fluid in a pulse tube by connecting an outlet port and an inlet port of the compressor to the regenerator via the high pressure valve and the low pressure valve, respectively;

means for selectively communicating plural different middle pressure levels with the high temperature heat exchanger, wherein each of said middle pressure levels being between an output pressure and an input pressure of the compressor; and a controller configured to arrange an opening condition of the high pressure valve, the low pressure valve and the buffer side valve so as not to overlap one another.

* * * * *